US008584286B2

(12) United States Patent
Call

(10) Patent No.: US 8,584,286 B2
(45) Date of Patent: Nov. 19, 2013

(54) SYSTEMS AND METHODS FOR PROVIDING A SELF DEFLATING CUSHION

(75) Inventor: Evan Call, Bountiful, UT (US)

(73) Assignee: EC Service Inc., Centerville, UT (US)

( * ) Notice: Subject to any disclaimer, the term of this patent is extended or adjusted under 35 U.S.C. 154(b) by 601 days.

(21) Appl. No.: 12/768,626

(22) Filed: Apr. 27, 2010

(65) Prior Publication Data

US 2011/0258782 A1 Oct. 27, 2011

(51) Int. Cl.
*B68G 5/00* (2006.01)

(52) U.S. Cl.
USPC ..... 5/655.3; 5/654; 5/655.5; 5/710; 5/711; 5/712; 5/713

(58) Field of Classification Search
USPC ..... 5/654, 655.3, 655.5, 710, 711, 712, 713
See application file for complete search history.

(56) References Cited

U.S. PATENT DOCUMENTS

| | | | |
|---|---|---|---|
| 4,389,742 | A | 6/1983 | DeWitt |
| 4,456,642 | A | 6/1984 | Burgdörfer et al. |
| 4,524,762 | A | 6/1985 | Schulman |
| 4,554,930 | A | 11/1985 | Kress |
| 4,579,390 | A | 4/1986 | Guille |
| 4,588,229 | A | 5/1986 | Jay |
| 4,605,582 | A | 8/1986 | Sias et al. |
| 4,615,856 | A | 10/1986 | Silverman |
| 4,629,246 | A | 12/1986 | Fulton |
| 4,637,789 | A | 1/1987 | Netznik |
| 4,639,012 | A | 1/1987 | Jensen |
| 4,643,481 | A | 2/1987 | Saloff et al. |
| 4,672,700 | A | 6/1987 | Poncy |
| 4,673,605 | A | 6/1987 | Sias et al. |
| 4,695,496 | A | 9/1987 | Lee |
| 4,698,864 | A | 10/1987 | Graebe |
| 4,709,431 | A | 12/1987 | Shaktman |
| 4,713,848 | A | 12/1987 | Domovs et al. |
| 4,726,624 | A | 2/1988 | Jay |
| 4,727,878 | A | 3/1988 | Levine |
| 4,728,551 | A | 3/1988 | Jay |
| 4,753,480 | A | 6/1988 | Morell |
| 4,753,705 | A | 6/1988 | Poncy |
| 4,793,652 | A | 12/1988 | Hannah et al. |
| 4,808,469 | A | 2/1989 | Hiles |
| 4,813,944 | A | 3/1989 | Haney et al. |
| 4,819,286 | A | 4/1989 | Beauchamp |
| 4,819,288 | A | 4/1989 | Lowthian |
| 4,827,546 | A | 5/1989 | Cvetkovic |
| 4,828,325 | A | 5/1989 | Brooks |
| 4,833,457 | A | 5/1989 | Graebe, Jr. |

(Continued)

FOREIGN PATENT DOCUMENTS

| | | | |
|---|---|---|---|
| WO | WO 94/06325 | A1 | 3/1994 |
| WO | WO 00/27332 | A1 | 5/2000 |

(Continued)

*Primary Examiner* — Robert G Santos
*Assistant Examiner* — Duoni Pan
(74) *Attorney, Agent, or Firm* — David B. Tingey; Kirton | McConkie

(57) ABSTRACT

Systems and methods for providing a self deflating cushion whereby a volume of air within the cushion is controllably released to a surface of the cushion thereby providing a cooling effect to the seated anatomy of a user. The cushion further provides a variety of internal, open cell cushioning materials that store and release air during use of the cushion.

20 Claims, 7 Drawing Sheets

(56) References Cited

U.S. PATENT DOCUMENTS 4,842,330 A 6/1989 Jay
4,852,195 A 8/1989 Schulman
4,860,397 A 8/1989 Gusakov
4,879,776 A 11/1989 Farley
4,890,235 A 12/1989 Reger et al.
4,912,788 A 4/1990 Lonardo
4,930,171 A 6/1990 Frantz
4,942,634 A 7/1990 Saloff et al.
4,945,571 A 8/1990 Calvert
4,949,713 A 8/1990 Mykietiuch
4,951,336 A 8/1990 Silverman
4,953,913 A 9/1990 Graebe
4,960,304 A 10/1990 Frantz
4,972,351 A 11/1990 Reger et al.
4,980,939 A 1/1991 Smith
4,989,283 A 2/1991 Krouskop
4,998,354 A 3/1991 Silverman et al.
5,018,790 A 5/1991 Jay
5,019,064 A 5/1991 Eilender
5,020,168 A 6/1991 Wood
5,035,467 A 7/1991 Axelson et al.
5,038,433 A 8/1991 Farley
5,044,030 A 9/1991 Balaton
5,044,647 A 9/1991 Patterson
5,052,068 A 10/1991 Graebe
5,056,533 A 10/1991 Solano
5,074,620 A 12/1991 Jay et al.
5,077,849 A 1/1992 Farley
5,083,551 A 1/1992 Addison, Jr.
5,088,747 A 2/1992 Morrison et al.
5,101,811 A 4/1992 Brunswick
5,102,195 A 4/1992 Axelson et al.
5,103,516 A 4/1992 Stevens
5,111,544 A 5/1992 Graebe
5,121,962 A 6/1992 Weber et al.
5,144,705 A 9/1992 Rogers
5,149,173 A 9/1992 Jay et al.
5,152,023 A 10/1992 Graebe
5,153,254 A 10/1992 Chen
5,154,185 A 10/1992 Latimer et al.
5,163,196 A 11/1992 Graebe et al.
5,163,737 A 11/1992 Navach et al.
5,168,583 A 12/1992 Wanke
5,178,811 A 1/1993 Farley
5,189,747 A 3/1993 Mundy et al.
5,193,285 A 3/1993 Heinrich et al.
5,224,754 A 7/1993 Jeanes, III
5,228,747 A 7/1993 Greene
5,231,718 A * 8/1993 Blaha et al. ..... 5/719
5,237,501 A 8/1993 Gusakov
5,248,182 A 9/1993 Hittie
5,262,468 A 11/1993 Chen
5,274,846 A 1/1994 Kolsky
5,277,474 A 1/1994 Hannagan et al.
5,282,286 A 2/1994 MacLeish
5,286,089 A 2/1994 Goldman
5,288,135 A 2/1994 Forcier et al.
5,297,021 A 3/1994 Koerlin et al.
5,330,249 A 7/1994 Weber et al.
5,333,921 A 8/1994 Dinsmoor, III
5,334,646 A 8/1994 Chen
5,335,975 A 8/1994 Krouskop et al.
5,336,708 A 8/1994 Chen
5,352,023 A 10/1994 Jay et al.
5,366,277 A 11/1994 Tremblay
5,369,828 A 12/1994 Graebe
5,369,829 A 12/1994 Jay
5,378,045 A 1/1995 Siekman et al.
D355,558 S 2/1995 Graebe
5,388,292 A * 2/1995 Stinson et al. ..... 5/682
5,395,162 A 3/1995 Jay et al.
5,397,517 A 3/1995 Jay et al.
5,407,481 A 4/1995 Drew
5,414,884 A 5/1995 Mackenzie
5,421,874 A 6/1995 Pearce
5,437,496 A 8/1995 Rickard
5,442,823 A 8/1995 Siekman et al.
5,444,881 A 8/1995 Landi et al.
5,445,433 A 8/1995 Avihod
5,449,002 A 9/1995 Goldman
5,452,940 A 9/1995 Maier
5,457,833 A 10/1995 Jay
5,459,896 A 10/1995 Raburn et al.
5,461,741 A 10/1995 Graebe
5,470,590 A 11/1995 Brubaker et al.
5,473,313 A 12/1995 Graebe, Jr.
5,474,362 A 12/1995 Albecker, III
5,487,197 A 1/1996 Iskra, Jr. et al.
5,490,299 A 2/1996 Dinsmoor, III et al.
5,494,725 A 2/1996 Fejes
5,500,965 A 3/1996 Hannagan et al.
5,502,855 A 4/1996 Graebe
5,507,866 A 4/1996 Drew et al.
5,508,334 A 4/1996 Chen
5,513,899 A 5/1996 Michaels et al.
5,522,105 A 6/1996 Fujiwara et al.
5,522,106 A 6/1996 Harrison et al.
5,522,793 A 6/1996 Cohen
5,524,439 A 6/1996 Gallup et al.
5,524,971 A 6/1996 Jay et al.
5,533,217 A 7/1996 Holdredge
5,533,220 A 7/1996 Sebag et al.
5,535,467 A 7/1996 Ciske
5,549,743 A 8/1996 Pearce
5,551,107 A 9/1996 Graebe
5,551,756 A 9/1996 Gurasich
5,556,169 A 9/1996 Parrish et al.
5,561,875 A * 10/1996 Graebe ..... 5/423
5,564,136 A 10/1996 Cox
5,564,788 A 10/1996 Warhaftig
5,568,660 A 10/1996 Raburn et al.
5,580,128 A 12/1996 Johnson et al.
5,592,706 A * 1/1997 Pearce ..... 5/654
5,592,707 A 1/1997 Dinsmoor, III et al.
5,596,781 A 1/1997 Graebe
5,597,203 A 1/1997 Hubbard
5,608,599 A 3/1997 Goldman
5,613,256 A 3/1997 Hanson
5,613,257 A 3/1997 Graebe
5,615,869 A 4/1997 Phillips et al.
5,617,595 A 4/1997 Landi et al.
5,626,021 A 5/1997 Karunasiri et al.
5,626,657 A 5/1997 Pearce
5,630,961 A 5/1997 Salee
5,633,286 A 5/1997 Chen
5,634,223 A 6/1997 Obermaier
5,636,900 A 6/1997 Wilkie et al.
5,638,565 A 6/1997 Pekar
5,639,145 A 6/1997 Alderman
5,639,543 A 6/1997 Isoda et al.
5,642,302 A 6/1997 Dumont et al.
D381,543 S 7/1997 Farley
5,645,314 A 7/1997 Liou
5,647,637 A 7/1997 Jay et al.
5,649,331 A 7/1997 Wilkinson et al.
5,651,151 A 7/1997 Schild
5,652,985 A 8/1997 Wilkinson et al.
5,657,499 A 8/1997 Vaughn et al.
5,662,123 A 9/1997 Goldman
5,662,384 A 9/1997 O'Neill et al.
5,671,977 A 9/1997 Jay et al.
5,678,265 A 10/1997 Meyer
5,678,266 A 10/1997 Petringa et al.
5,678,891 A 10/1997 O'Neill et al.
5,680,662 A 10/1997 Purdy et al.
5,681,092 A 10/1997 Hanson et al.
D386,036 S 11/1997 Laidlaw
5,687,436 A 11/1997 Denton
5,687,438 A 11/1997 Biggie et al.
5,688,236 A 11/1997 Gragg
5,689,845 A 11/1997 Sobieralski
5,695,245 A 12/1997 Carlson et al.
5,695,248 A 12/1997 Bell
5,700,060 A 12/1997 Bullard et al.

(56) References Cited

U.S. PATENT DOCUMENTS 5,701,621 A 12/1997 Landi et al.
5,702,153 A 12/1997 Pliska
5,711,573 A 1/1998 Daniels et al.
5,715,548 A 2/1998 Weismiller et al.
5,722,729 A 3/1998 Carilli
5,735,575 A 4/1998 Harza
5,741,380 A 4/1998 Hoyle et al.
D394,578 S 5/1998 Raburn
5,745,942 A * 5/1998 Wilkerson ..... 5/715
5,749,111 A 5/1998 Pearce
5,758,926 A 6/1998 Wilkie et al.
5,766,704 A 6/1998 Allen et al.
5,769,488 A 6/1998 Daniels et al.
5,775,332 A 7/1998 Goldman
D396,981 S 8/1998 Laidlaw
5,787,533 A 8/1998 Fromme
5,797,155 A 8/1998 Maier et al.
5,800,480 A 9/1998 Augustine et al.
D399,694 S 10/1998 Laidlaw
5,815,864 A 10/1998 Sloop
5,823,621 A 10/1998 Broadhead
5,829,081 A 11/1998 Pearce
5,836,025 A 11/1998 Poncy, Sr.
5,836,654 A 11/1998 DeBellis et al.
5,837,002 A 11/1998 Augustine et al.
5,839,140 A 11/1998 Wilkerson
5,840,400 A 11/1998 Landi et al.
5,845,352 A 12/1998 Matsler et al.
5,848,824 A 12/1998 Mocur
5,851,457 A 12/1998 Peterson et al.
5,857,749 A 1/1999 DeBellis et al.
5,865,504 A 2/1999 Warhaftig
5,868,463 A 2/1999 MacKenzie et al.
5,869,164 A 2/1999 Nickerson et al.
5,881,407 A 3/1999 Chu Pt
5,881,409 A 3/1999 Pearce
5,884,639 A 3/1999 Chen
5,893,184 A 4/1999 Murphy
5,906,416 A 5/1999 Rasmussen
5,906,887 A 5/1999 Withers
5,913,568 A 6/1999 Brightbill et al.
5,918,317 A 7/1999 Bernhardt
5,918,334 A 7/1999 Laidlaw
5,930,152 A 7/1999 Dumont et al.
5,933,891 A 8/1999 Nachod, III
5,947,562 A 9/1999 Christofferson et al.
5,950,263 A 9/1999 Hanson et al.
5,954,402 A 9/1999 McInturff
5,963,997 A 10/1999 Hagopian
5,984,418 A 11/1999 McInturff
5,985,383 A 11/1999 Allen et al.
5,994,450 A 11/1999 Pearce
6,003,949 A 12/1999 Rinne et al.
6,007,572 A 12/1999 Baldwin
6,009,578 A 1/2000 Davis
6,010,528 A 1/2000 Augustine et al.
6,012,184 A 1/2000 Childers
6,012,188 A 1/2000 Daniels et al.
6,014,784 A 1/2000 Taylor et al.
6,015,394 A 1/2000 Young
6,018,832 A 2/2000 Graebe
6,020,055 A 2/2000 Pearce
6,025,067 A 2/2000 Fay
6,026,527 A 2/2000 Pearce
6,027,674 A 2/2000 Yates
6,032,975 A 3/2000 Hanson et al.
6,033,025 A 3/2000 Christofferson et al.
6,033,432 A 3/2000 Augustine et al.
6,035,901 A 3/2000 Stumpf et al.
6,036,271 A 3/2000 Wilkinson et al.
6,044,506 A 4/2000 Valene
6,050,871 A 4/2000 Chen
6,056,278 A 5/2000 Bullard et al.
6,059,370 A 5/2000 Kanyer et al.
6,063,461 A 5/2000 Hoyle et al.
6,068,280 A 5/2000 Torres
6,079,782 A 6/2000 Berg et al.
6,080,462 A 6/2000 Gordan
6,082,824 A 7/2000 Chow
6,083,435 A 7/2000 Albecker, III
6,083,857 A 7/2000 Böttger et al.
6,085,369 A 7/2000 Feher
6,092,249 A 7/2000 Kamen et al.
6,098,221 A 8/2000 Kloppenborg
6,113,189 A 9/2000 Bennett et al.
6,117,176 A 9/2000 Chen
6,120,630 A 9/2000 Lorbiecki
6,123,716 A 9/2000 Augustine et al.
6,125,851 A 10/2000 Walker et al.
6,126,186 A 10/2000 Mascari
6,132,004 A 10/2000 Carlino
6,132,455 A 10/2000 Shang
6,142,573 A 11/2000 Harding et al.
6,148,830 A 11/2000 Chen
6,158,814 A 12/2000 Cole
6,161,238 A 12/2000 Graebe
6,175,980 B1 1/2001 Gaither
6,187,837 B1 2/2001 Pearce
6,189,967 B1 2/2001 Short
6,193,318 B1 2/2001 Becker et al.
6,197,099 B1 3/2001 Pearce
6,206,393 B1 3/2001 Mascari et al.
6,209,159 B1 4/2001 Murphy
6,210,427 B1 4/2001 Augustine et al.
6,212,718 B1 4/2001 Stolpmann et al.
6,213,558 B1 4/2001 Axelson et al.
6,216,299 B1 4/2001 Kohlman
6,224,156 B1 5/2001 Fleigle
6,224,160 B1 5/2001 Takeuchi et al.
6,224,623 B1 5/2001 Augustine et al.
6,230,351 B1 5/2001 Kohnle
6,230,501 B1 5/2001 Bailey, Sr. et al.
6,241,319 B1 6/2001 Liegnell
6,241,320 B1 6/2001 Chew et al.
6,253,400 B1 7/2001 Rüdt-Sturzenegger et al.
6,256,819 B1 7/2001 Maier et al.
6,263,530 B1 7/2001 Feher
6,264,279 B1 7/2001 Chow
6,269,504 B1 * 8/2001 Romano et al. ..... 5/690
6,269,505 B1 8/2001 Wilkinson
6,276,704 B1 8/2001 Suiter
6,290,293 B1 9/2001 Long et al.
6,312,051 B1 11/2001 Adams
6,319,441 B1 11/2001 Yates
6,321,404 B1 11/2001 Tsai
6,322,145 B1 11/2001 Melgarejo et al.
6,324,703 B1 12/2001 Chen
6,333,374 B1 12/2001 Chen
6,352,273 B1 3/2002 Dickie
6,352,307 B1 3/2002 Engman
6,357,829 B1 3/2002 Hanke
6,367,106 B1 4/2002 Gronsman
6,370,716 B1 4/2002 Wilkinson
6,378,152 B1 4/2002 Washburn et al.
6,378,947 B1 4/2002 Barber et al.
6,386,575 B1 5/2002 Turner
6,390,554 B1 5/2002 Eakins et al.
6,393,642 B1 5/2002 Pollman et al.
6,394,476 B1 5/2002 Molnar
6,398,310 B1 6/2002 Seeliger
6,413,455 B1 7/2002 Yates
6,413,458 B1 7/2002 Pearce
6,415,467 B1 7/2002 Bretvin
6,415,814 B1 7/2002 Hand et al.
6,416,272 B1 7/2002 Suehiro et al.
6,420,475 B1 7/2002 Chen
6,425,153 B1 7/2002 Reswick
6,433,033 B1 8/2002 Isobe et al.
6,442,780 B1 9/2002 Phillips et al.
6,497,720 B1 12/2002 Augustine et al.
6,498,199 B1 12/2002 Yates
6,519,797 B1 2/2003 Brubaker et al.
6,552,109 B1 4/2003 Chen
6,555,214 B1 4/2003 Yates

(56) References Cited

U.S. PATENT DOCUMENTS

| | | | |
|---|---|---|---|
| 6,564,410 | B2 | 5/2003 | Graebe et al. |
| 6,571,825 | B2 | 6/2003 | Stacy |
| 6,611,980 | B2 | 9/2003 | Wempe |
| 6,623,847 | B2 | 9/2003 | Yates |
| 6,625,830 | B2 | 9/2003 | Lampel |
| 6,668,405 | B1 | 12/2003 | Kohlman |
| 6,687,936 | B2 | 2/2004 | Graebe et al. |
| 6,705,674 | B1 | 3/2004 | McMahan et al. |
| 6,739,008 | B1 | 5/2004 | Kindrick |
| 6,755,477 | B2 | 6/2004 | Chow |
| 6,772,639 | B2 | 8/2004 | Seals |
| 6,848,135 | B1 | 2/2005 | Kohlman |
| 6,857,151 | B2 | 2/2005 | Jusiak et al. |
| 6,867,253 | B1 | 3/2005 | Chen |
| 6,872,755 | B1 | 3/2005 | Yates |
| 6,901,617 | B2 | 6/2005 | Sprouse, II et al. |
| 6,908,662 | B2 | 6/2005 | Pearce |
| 6,909,220 | B2 | 6/2005 | Chen |
| 6,941,602 | B2 | 9/2005 | Brubaker et al. |
| 6,990,744 | B2 | 1/2006 | Bieganek et al. |
| 6,996,864 | B2 | 2/2006 | Call |
| 7,026,940 | B2 | 4/2006 | Cherubini |
| 7,060,213 | B2 | 6/2006 | Pearce |
| 7,066,549 | B2 | 6/2006 | Dennon et al. |
| 7,067,583 | B2 | 6/2006 | Chen |
| 7,076,822 | B2 | 7/2006 | Pearce |
| 7,087,806 | B2 | 8/2006 | Scheinberg et al. |
| 7,105,607 | B2 | 9/2006 | Chen |
| 7,134,929 | B2 | 11/2006 | Chen |
| 7,140,057 | B2 | 11/2006 | Hetzel et al. |
| 7,146,666 | B2 | 12/2006 | Christofferson et al. |
| 7,159,259 | B2 | 1/2007 | Chen |
| 7,166,672 | B2 | 1/2007 | Handlin, Jr. et al. |
| 7,193,002 | B2 | 3/2007 | Chen |
| 7,216,388 | B2 | 5/2007 | Bieganek et al. |
| 7,220,376 | B2 | 5/2007 | Hetzel et al. |
| 7,222,380 | B2 | 5/2007 | Chen |
| 7,225,486 | B2 | 6/2007 | Jackson, III |
| 7,226,484 | B2 | 6/2007 | Chen |
| 7,234,560 | B2 | 6/2007 | Chen |
| 7,290,367 | B2 | 11/2007 | Chen |
| 2001/0002081 | A1 | 5/2001 | Toppses |
| 2001/0011805 | A1 | 8/2001 | Kueschall |
| 2001/0013146 | A1 | 8/2001 | Wempe |
| 2002/0108179 | A1* | 8/2002 | Kiser ..... 5/654 |
| 2005/0097674 | A1* | 5/2005 | Mileti ..... 5/710 |

FOREIGN PATENT DOCUMENTS

| | | | |
|---|---|---|---|
| WO | WO 01/32120 | A1 | 5/2001 |
| WO | WO 01/35892 | A2 | 5/2001 |
| WO | WO 01/43685 | A1 | 6/2001 |
| WO | WO 01/85533 | A1 | 11/2001 |
| WO | WO 01/89442 | A1 | 11/2001 |
| WO | WO 02/28339 | A2 | 4/2002 |
| WO | WO 02/28339 | A3 | 4/2002 |

* cited by examiner

SYSTEMS AND METHODS FOR PROVIDING A SELF DEFLATING CUSHION

BACKGROUND OF THE INVENTION

1. Field of the Invention

The present invention relates to system and methods for providing an air cushion. Specifically, the present invention relates to an air cushion having a plurality of air chambers configured to permitted leakage of air in a controlled manner, thereby providing a cooling effect to a user.

2. Background and Related Art

Thermal interaction between the body and seating surfaces can result in elevated tissue temperature and moisture build-up, which may increase the risk of pressure ulcers associated with prolonged ischemia or due to macerative damage. Both the materials and geometry of current commercial seating and cushioning systems are thought to influence the body-support surface microclimate. Although much attention has been directed to the reduction of ischemia-initiated soft tissue injury through mechanical means, the influence of tissue temperature and the effect of moisture have been neglected.

Support surfaces such as wheelchair cushions, other seating surfaces, and mattresses can have a major influence on the microclimate experienced by the interfacing tissues and are thought to be the result of a complex interaction between tissue physiology, environmental conditions, and the properties of the materials used in the construction of the seating system when loaded by the body and their overall geometry. The requirements of users of seating systems also vary considerably depending on levels of exertion, environmental conditions, and physiological factors, including those that may be associated with pathology, such as reflex sweating or vulnerability to hyper- or hypothermia.

Thus, while techniques currently exist that relate to seating surface optimization, challenges still exist. Accordingly, it would be an improvement in the art to augment or even replace current techniques with other techniques.

SUMMARY OF THE INVENTION

The present invention relates to system and methods for providing an air cushion. Specifically, the present invention relates to an air cushion having a plurality of air chambers configured to permitted leakage of air in a controlled manner, thereby providing a cooling effect to a user.

In some implementations of the present invention, a cushion is provided having features whereby a volume of air within the cushion is controllably leaked through a top surface of the cushion to provide a cooling effect to a user. Following removal of the user, the elastic properties of the cushion causes the cushion to resume its original configuration thereby causing air to be drawn into the cushion via the top surface. In some implementations the top surface includes an opening proximate to a desired anatomy of the user such that an increased rate of air flow through the opening causes additional cooling to the targeted user anatomy. In other embodiments, the top surface includes a breathable material having a porosity configured to achieve a desired rate of air flow.

Further, in some implementations of the present invention an enclosure is provided as a base for the top surface. The enclosure includes an interior lumen wherein various cushion materials are disposed. In some implementations, the enclosure further includes a non-breathable coating or covering such that air flow in and out of the cushion is restricted to the top surface. In other implementations, a one-way valve is provided between an exterior environment and the interior lumen whereby air is rapidly brought into the interior lumen via the one-way valve. The enclosure generally includes an open cell foam material that displays elastic properties following structural deformation. Still further, in some implementations an air exhaust port is provided in the coating to enable air flow between the enclosure and the interior lumen.

Some implementations of the present invention further include an internal lumen having a plurality of distinct air chambers. In some implementations a barrier is provided between adjacent air chambers to permit air passage therebetween at a desired rate of flow. Air chambers are further fitted with cushioning materials to provide support, comfort and structural stability to the cushion device as needed.

Some implementations of the present invention further include a gel insert disposed between the interior lumen and the top surface. The gel insert generally includes a gel or gel-like material provided to increase the user comfort associated with using the cushion. In some implementations the gel insert includes a plurality of gel pads disposed in a breathable film material.

The present invention further provides a method whereby a cushion device in accordance with the present invention is manufactured.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to system and methods for providing an air cushion. Specifically, the present invention relates to an air cushion having a plurality of air chambers configured to permitted leakage of air in a controlled manner, thereby providing a cooling effect to a user.

As used herein, the term "open cell" refers generally to any material containing pores that are connected to each other and form an interconnected network. Some uses of the term "open cell" refer to foam materials that relatively soft.

As used herein, the term "closed cell" refers generally to any material not having interconnected pores. Some uses of the term "closed cell" refer to foam materials having higher compression strength relative to open cell materials.

As used herein, the term "gel" refers to a solid, jelly-like material that can have properties ranging from soft and weak to hard and tough. Gels are further defined as a substantially dilute crosslinked system, which exhibits no flow when in the steady-state.

As used herein, the term "exterior surface" refers to a visible surface of a component.

Figure 1A:
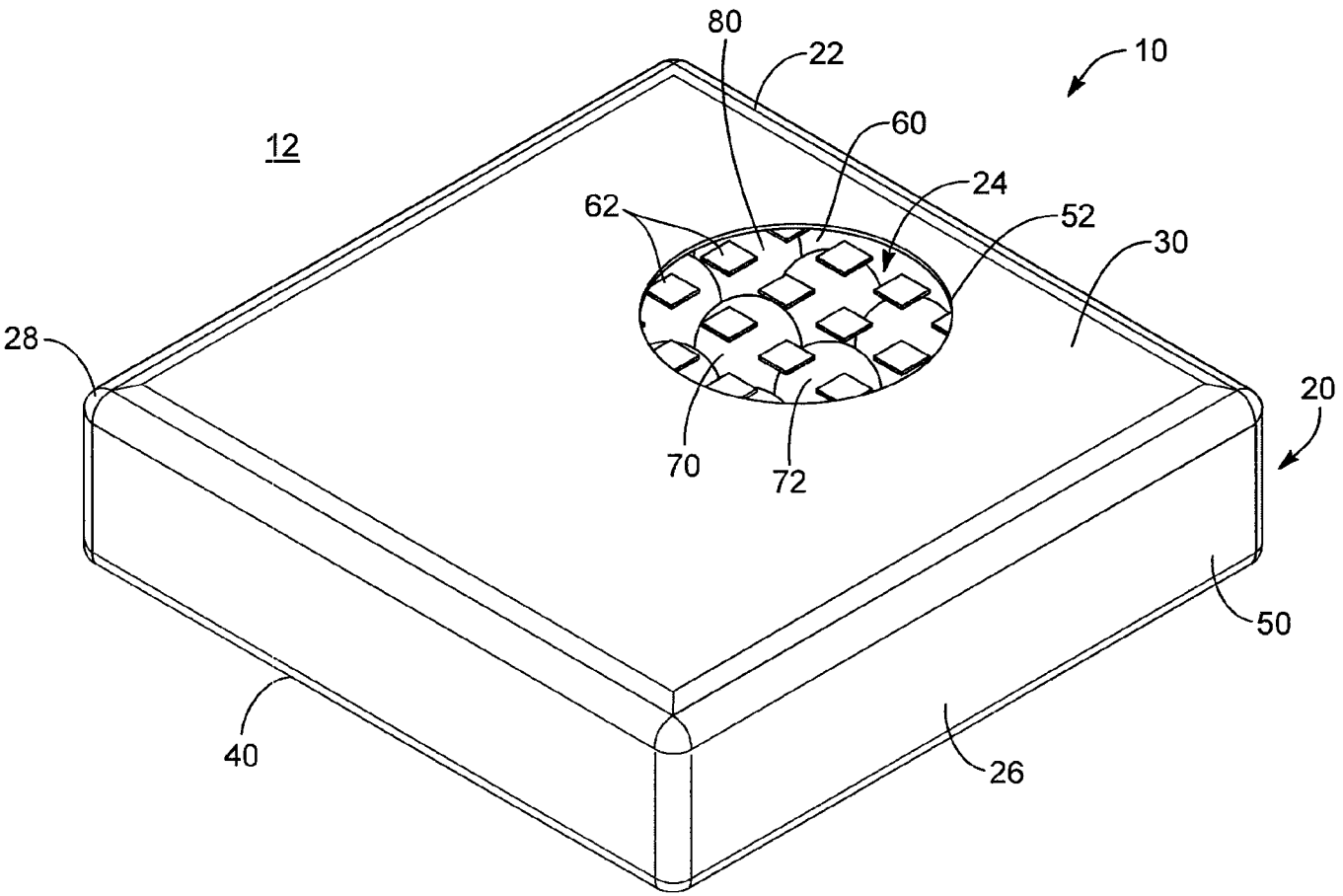
FIG. 1A is a perspective view of a cushion device in accordance with a representative embodiment of the present invention.

With reference now to FIG. 1A, a perspective view of an air cushion 10 is shown. In some embodiments, air cushion 10 comprises an outer enclosure 20 having a top surface 30, a bottom surface 40, and a perimeter surface 50. Enclosure 20 generally provides a container for housing various components of cushion 10, as described below.

In some embodiments, bottom surface 40 and perimeter surface 50 comprises a unitary structure having an opening 22. Opening 22 may include any size and/or dimensions necessary to provide access to an interior lumen 24 of enclosure 20. Thus, in some embodiments enclosure 20 comprises a box-like configuration having an open top. For these embodiments, top surface 30 is subsequently added to enclosure 20 thereby providing an enclosed interior lumen 24.

Some embodiments of enclosure 20 further comprise a non-breathable covering or coating 26 applied to an exterior surface 28. Coating 26 provides a barrier to prevent or limit passage of air between interior lumen 24 and exterior environment 12 via bottom and perimeter surfaces 49 and 50. In some embodiments, coating 26 comprises a polyvinyl chloride (PVC) material applied directly to exterior surface 28. In other embodiments, coating 26 comprises a non-breathable material sleeve, jacket or casing (such as PVC) having an interior space into which enclosure 20 is inserted. Further, in some embodiments coating 26 comprises an air exhaust port to control air flow between interior lumen 24 and enclosure 20.

Enclosure 20 generally comprises a compressible material selected to provide adequate support to a user. For example, in some embodiments enclosure 20 comprises a semi-rigid compressible polymer material having elastic properties. Non-limiting examples of a suitable polymer material include open cell foam, reticulated foam, foam rubber, visco elastic foam, memory foam, and closed cell foam. The elastic properties of enclosure 20 cause the structure to resumes its shape following use. In some embodiments, a density of enclosure 20 is selected based on an anticipated load. For example, a cushion enclosure designed for a child may include a material having a lesser density than a cushion enclosure designed for use by an adult.

Further, in some embodiments enclosure 20 includes a size and/or diameter configured for use in a specific application. For example, in some embodiments enclosure 20 is configured for use as a wheel chair cushion. In other embodiments, enclosure 20 is configured for use as a car seat cushion. Still further, in some embodiments enclosure 20 is configured for use as at least one of a chair cushion, a bicycle seat cushion, and an airplane seat cushion.

Top surface 30 acts as a barrier between inner lumen 24 and an exterior environment 12. In some embodiments, top surface 30 comprises a microporous, breathable material such as a Gore-Tex® material, a Stomatex® material, and/or a polyester microfiber. In other embodiments, top surface 30 comprises a breathable, woven or non-woven material having a waterproof coating, such as a polyurethane coating. Other non-limiting examples of suitable materials may include Membrain™, Conduit™, Hyvent™, Cloudburst Stretch EV3™, and H2NO™ materials.

In some embodiments, top surface 30 is sealedly coupled to enclosure 20 to close opening 22. The microporous structure of top surface 30 controls and/or limits passage of air, vapors and liquids from exterior environment 12 into interior lumen 24. Conversely, the microporous structure of top surface 30 controls and/or limits passage of air from interior lumen 24 into exterior environment 12. Thus, top surface 30 acts as a valve between interior lumen 24 and exterior environment 12.

In some embodiments, the rate of exchange between interior lumen 24 and exterior environment 12 is a function of the top surface 30 material pore-size. For example, in some embodiments top surface 30 comprises a material having a pore-size to prevent passage of vapors and fluids, yet readily permit passage of air. In other embodiments, top surface 30 comprises a material having a determined pore-size to permit passage of air at a desired rate. Still further, in some embodiments top surface 30 comprises a plurality of layers, wherein the combined porosity of the individual layers results in a desired rate of exchange between interior lumen 24 and exterior environment 12.

In some embodiments, the rate of exchange between interior lumen 24 and exterior environment 12 is a function of the top surface 30 material pore-size, and a force or load being applied to cushion 10. For example, in some embodiments top surface 30 permits passage of air from interior lumen 24 into exterior environment 12 as a result of increased pressure within interior lumen 24. Such increased pressure may occur due to a user sitting on the cushion 10. Further, in some embodiments top surface 30 permits passage of air from exterior environment 12 into interior lumen 24 as a result of decreased or negative pressure within interior lumen 24. Such negative pressure may occur as a result of excessive air loss from interior lumen 24. Such negative pressure may also occur as enclosure 20 elastically resumes it initial shape following removal of a user. The negative pressure is neutralized as a volume of air passes through top surface 30 to refill interior lumen 24.

In some embodiments, top surface 30 further comprises an opening 32 to permit increased air flow proximate to a desired anatomy of a user. For example, in some embodiments an opening 32 is provided approximate to the perineum of a user. In other embodiments, an opening 32 is provided approximate to the buttocks of the user. Further, in some embodiments an opening 32 is provided approximate to at least one of the genitalia, legs, arms, back, head, neck and/or feet of the user.

Opening 32 may include any quantity, size and configuration necessary to provide a desired air flow to a targeted anatomy of a user. For example, in some embodiments opening 32 comprises a single hole having a diameter to approximate the area of the desired user anatomy. In other embodiments, opening 32 comprises a plurality of adjacent openings having a cumulative diameter to approximate the area of the desired user anatomy. For example, in some embodiments opening 32 comprises a plurality of punctures having a controlled size and pattern to effect directed cooling relief Further, in some embodiments opening 32 comprises a region of top surface 30 having an increased pore-size relative to the remaining pore-sizes of the material.

In some embodiments, interior lumen 24 further comprises a gel insert 60. Gel insert 60 generally includes a polymeric cushioning material placed adjacent to top surface 30. In some embodiments, gel insert 60 provides textural comfort to a user. In other embodiments, gel insert 60 provides ergonomic structure to accommodate the anatomy of a user.

Some embodiments of gel insert 60 comprise a plurality of gel pads 62 arranged in a desired configuration and disposed in a matrix of breathable film material 70. Non-limiting examples of gel pads 62 may include Ultra-Soft® blue gel, viscoelastic polymers, plastisol, silicon, an aerogel, a cationic polymer, an organogel, a xerogel, and copolymers of vinylpyrrolidone, methacrylamide, and hydrogel N-vinylimidazole. Non-limiting examples of film material 70 may include Gore-Tex®, Stomatex®, polyesther microfiber, polyurethane, Membrain™, Conduit™, Hyvent™, Cloudburst Stretch EV3™, woven materials, non-woven porous materials, and H2NO™ materials. In some embodiments, the permeability of gel insert 60 permits passage of air between interior lumen 24 and top surface 30. In other embodiments, the permeability of gel insert 60 is combined with top surface 30 to provide a desired rate air exchange between interior lumen 24 and exterior environment 12.

Some embodiments of cushion 10 further comprise a cushion insert 80. Insert 80 generally comprises a cushioning material configured to provide support to a user. In some embodiments, insert 80 comprises a plurality of individual cushioning unit 82 arranged in a desired pattern or configuration. Cushioning units 82 may include any open or closed cell materials, as described above. In some embodiments, cushioning units 82 comprise a combination of cushioning materials having various densities, as shown in FIG. 2A.

Figure 1B:
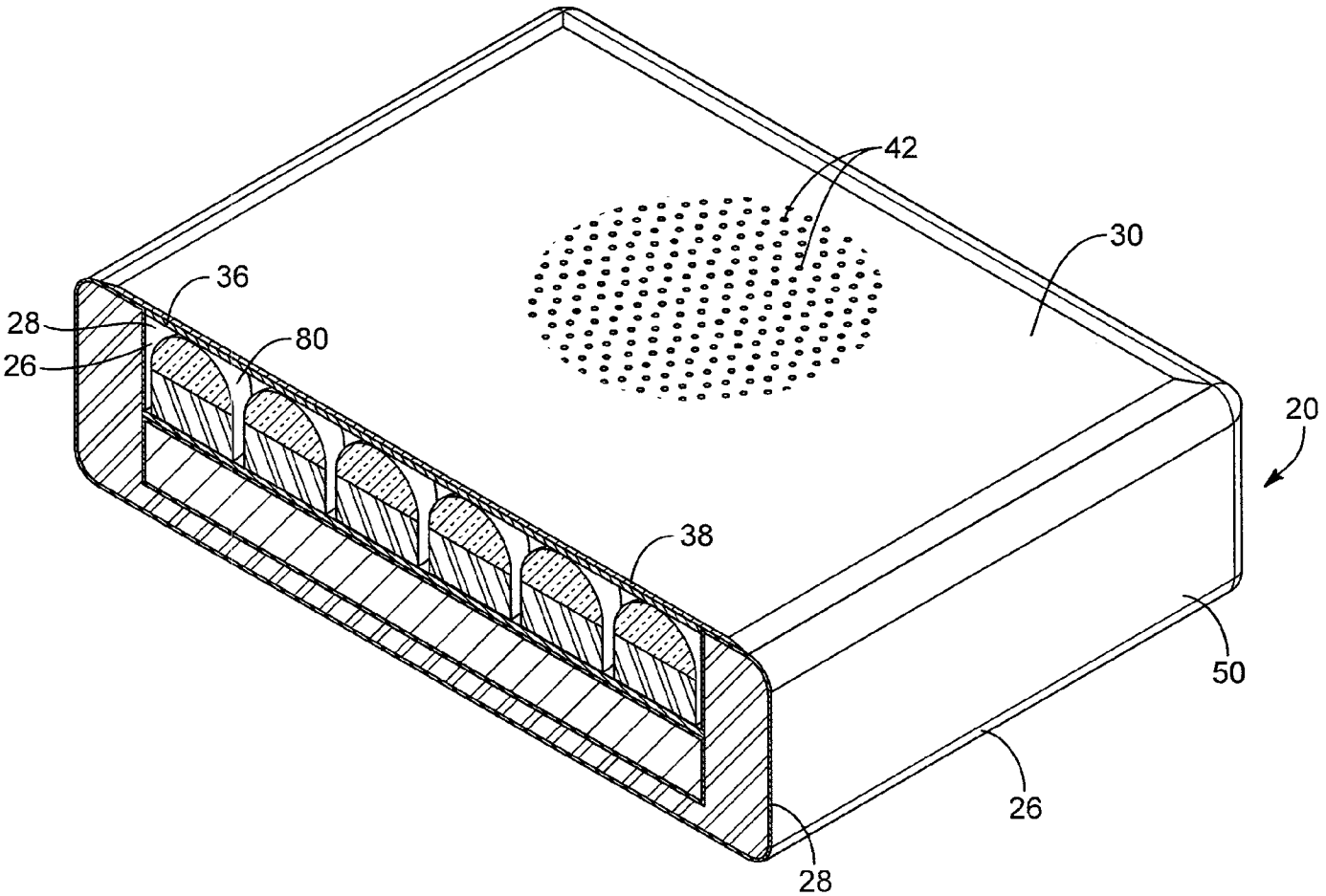
FIG. 1B is a cross-section view of a cushion device in accordance with a representative embodiment of the present invention.

In some embodiments, top surface 30 comprises a membrane 38 laminated to a fabric material 36, as shown in FIG. 1B. In some embodiments, membrane 38 comprises a plurality of pores 42 of controlled size and placement in a desired pattern. The size and placement of the plurality of pores 42 is generally selected so as to provide desired air flow to tissue locations of greatest risk. In some embodiments, pores 42 are provided by puncturing an air-impervious membrane 38 with a needle or blade in the appropriate locations to provide a desired pattern or shape. In other embodiments, membrane 38 comprises a grid work of holes or pores that are selectively occluded with an occlusive ink or paint to provide a desired air-flow pattern. Further, in other embodiments membrane 38 comprises a breathable material to which is added an occlusive ink or paint to selectively limit the breathability of the material so as to provide a desired air-flow pattern. By coating the membrane to create a pattern of non-occluded locations or pores 42 at the points of interest, it is possible to generate a proper discharge rate of air to cool the desired body contact areas. Further, the embodiments of the present invention provide for a slow, controlled discharge rate of air thereby providing a period of cooling relief between patient relief lifts.

Figure 2A:
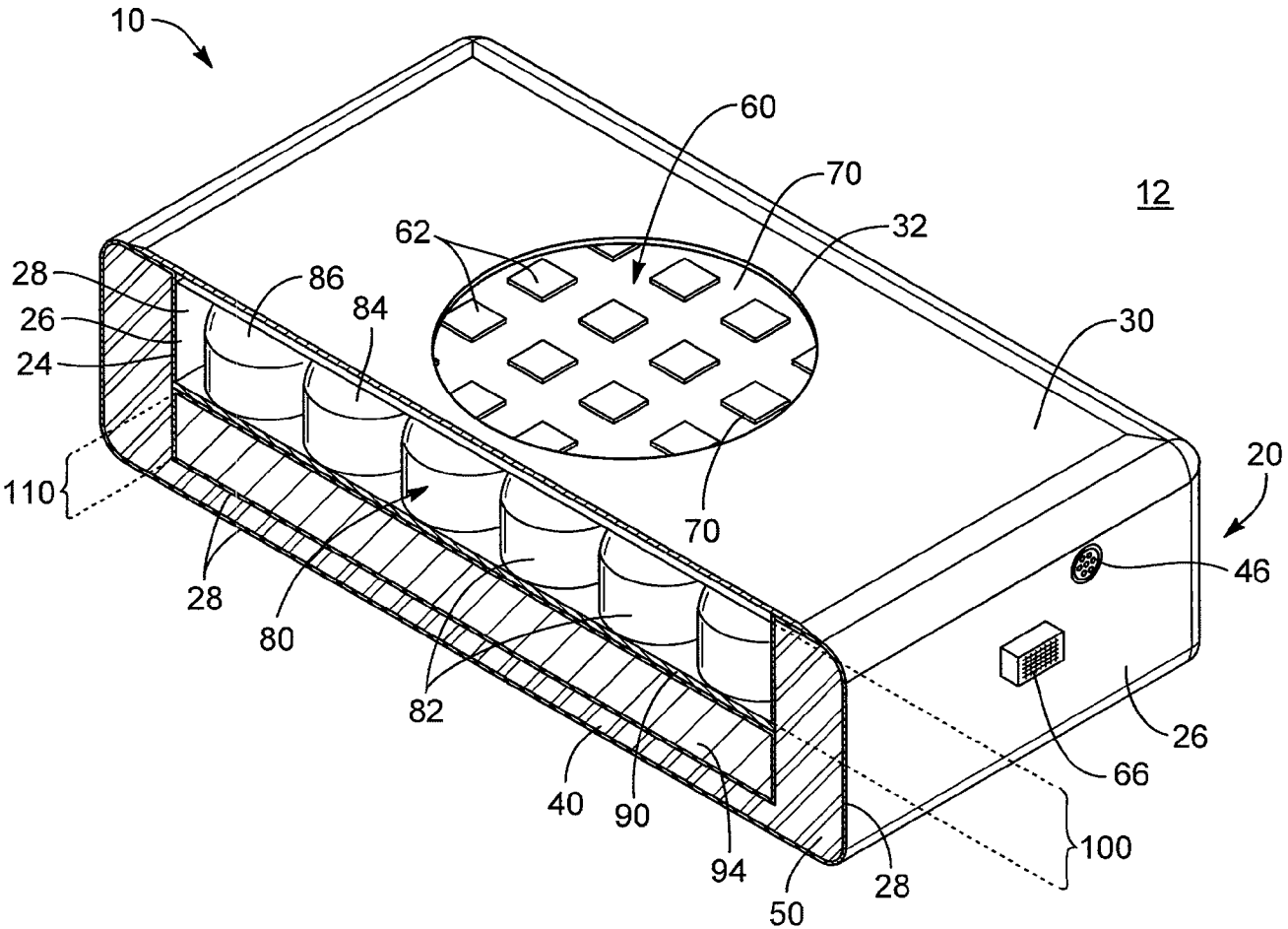
FIG. 2A is a cross-section view of a cushion device in accordance with a representative embodiment of the present invention.

Referring now to FIG. 2A, a cross-section cushion 10 is shown. In some embodiments, cushioning units 82 comprise a first cushioning material 84 forming a base portion. In some embodiments, material 84 comprises a material having a density sufficient to support the weight of a user. Material 86 generally comprises a lower density material to provide tactile or textural comfort to the user. Thus, as the user sits on top surface 30, gel pads 62 and material 86 provide combined textural comfort while material 84 provides structural support to the cushion 10. In some embodiments, the intermittent spacing of cushioning units 82 increases blood circulation in the user's interfacing anatomy, and further provides channels whereby air may leak though top surface 30 to interact with the user. Further, in some embodiments materials 84 and 86 are porous, resilient, elastic materials that naturally resume their shape or configuration following removal of the user. As such, following removal of the user materials 84 and 86 resume their initial shape thereby drawing in a volume of air through top surface 30 and recharging cushion 10 with usable air.

Figure 2B:
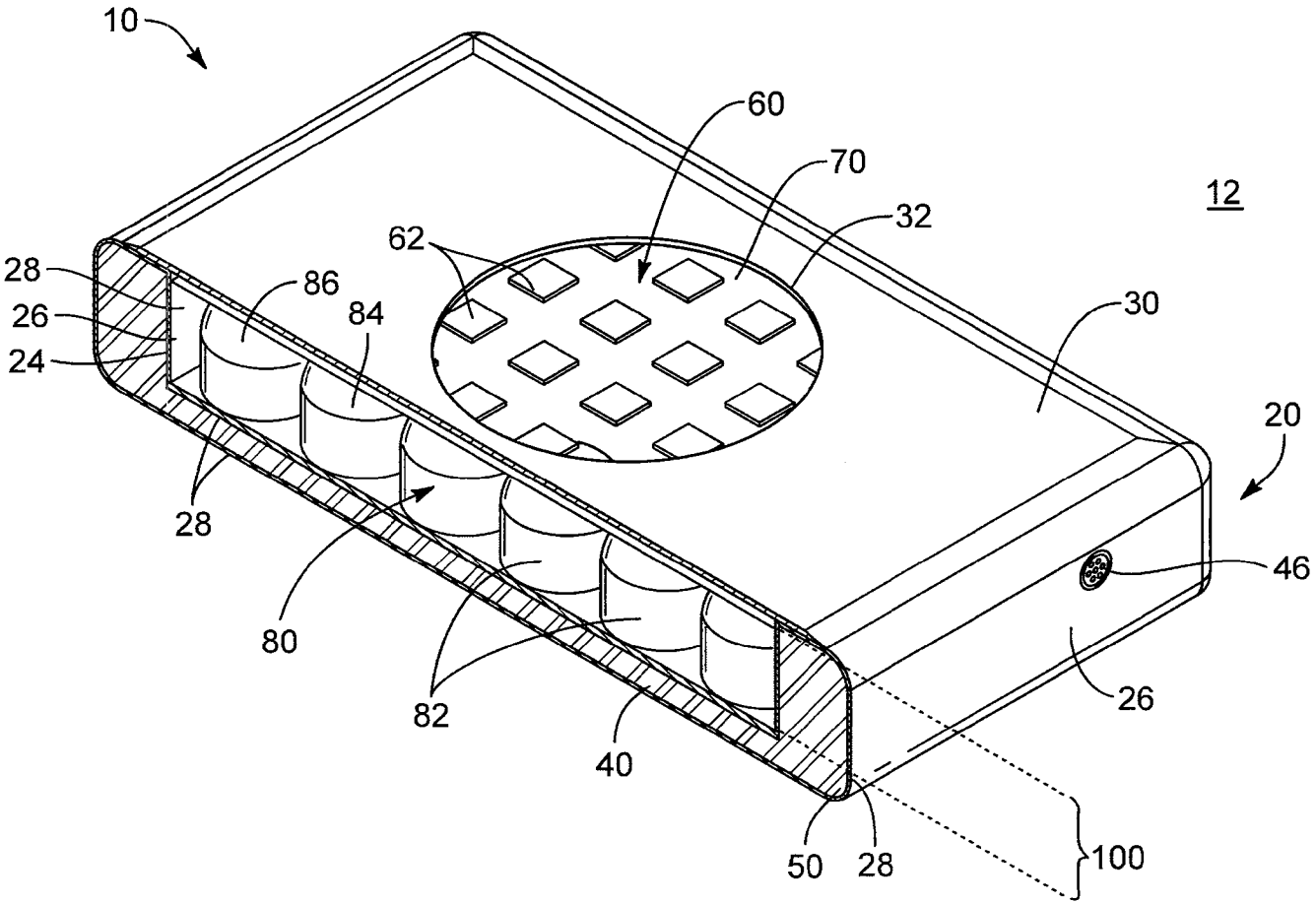
FIG. 2B is a cross-section view of a cushion device in accordance with a representative embodiment of the present invention.

In some embodiments, cushion 10 further comprises a breathable barrier 90 interposed between an upper chamber or first air chamber 100 and a lower or second air chamber 110. In some embodiments, barrier 90 is sealedly coupled to the exterior surface 28 of interior lumen 24. The microporous structure of barrier 90 controls and/or limits passage of air between first air chamber 100 and second air chamber 110. Thus, barrier 90 acts as a valve between first and second air chambers 100 and 110. In other embodiments, cushion 10 comprises a single air chamber 100, as shown in FIG. 2B. Further, in some embodiments cushion 10 comprises a single air chamber 100 having a porous top surface 30. Still further, in some embodiments cushion 10 comprises a single air chamber 100 having a porous top surface 30 and a porous membrane 70, as shown.

With continued reference to FIG. 2A, in some embodiments barrier 90 is entirely impervious to air such that air exchange between the first and second air chambers 100 and 110 does not occur. Thus, in some embodiments the function of the first air chamber 100 is independent from the function of the second air chamber 110. For example, in some embodiments the first air chamber 100 comprises an air-exchange function with exterior environment 12, while the second air chamber 100 functions only to retain a base cushion 94. In other embodiments, air exchange between the first air chamber 100 and exterior environment 12 is independent from air exchange between the second air chamber 110 and exterior environment 12.

In some embodiments, the rate of exchange between first and second air chambers 100 and 110 is a function of barrier 90 material pore-size. For example, in some embodiments barrier 90 comprises a material having a pore-size to readily permit passage of air between the adjacent air chambers. In other embodiments, barrier 90 comprises a material having a determined pore-size to permit passage of air at a desired rate. Still further, in some embodiments barrier 90 comprises a material having a pore-size that is greater than the pore-size of top surface 30, such that air passes through top surface 30 at a rate slower than the air-passage rate for barrier 90. In some embodiments, the pore-size of barrier 90 is approximately equal to the pore-size of top surface 30.

Some embodiments of cushion 10 further comprise a base cushion 94. Base cushion 94 generally comprises an open or closed cell material, as discussed above. In some embodiments, base cushion 94 comprises a reticulated foam, such as a Dry-Fast™ open cell foam. In some embodiments, base cushion 94 comprises a material having a density greater than cushion insert 80 thereby providing additional structural stability to the cushion 10. In other embodiments, the porosity of cushion 94 provides storage of air that will be ultimately dispersed to a user via top surface 30. Further, cushion 94 generally comprises an elastic material such that upon removal of the user, cushion 94 resumes it initial shape thereby drawing in a volume of air through top surface 30 and barrier 90.

In some embodiments, enclosure 20 further comprises a one-way valve 46. Valve 46 is generally disposed on a perimeter surface 50 of enclosure 20 and provides one-way fluid communication between exterior environment 12 and at least one of first and second air chambers 100 and 110, respectively. In some embodiments, one-way valve 46 is provided as a means for rapidly recharging or refilling air chambers 100 and 110 following removal of the user from top surface 30, such as a pressure relief lift. Thus, valve 46 generally limits air flow to passage of air from exterior environment 12 into air chambers 100 and/or 110.

In some embodiments, enclosure 20 further comprises an air pump 66. Air pump 66 provides air flow for rapidly recharging or refilling air chambers 100 and 110. Air pump 66 may be useful for either refilling air chambers 100 and 110 during a pressure relief lift or for filling air chambers 100 and 110 while the patient remains seated, such as for a quadriplegic patient. In some embodiments, air pump 66 is battery powered. In other embodiments, air pump 66 is powered by the power source of a wheel chair or patient bed.

Figure 3:
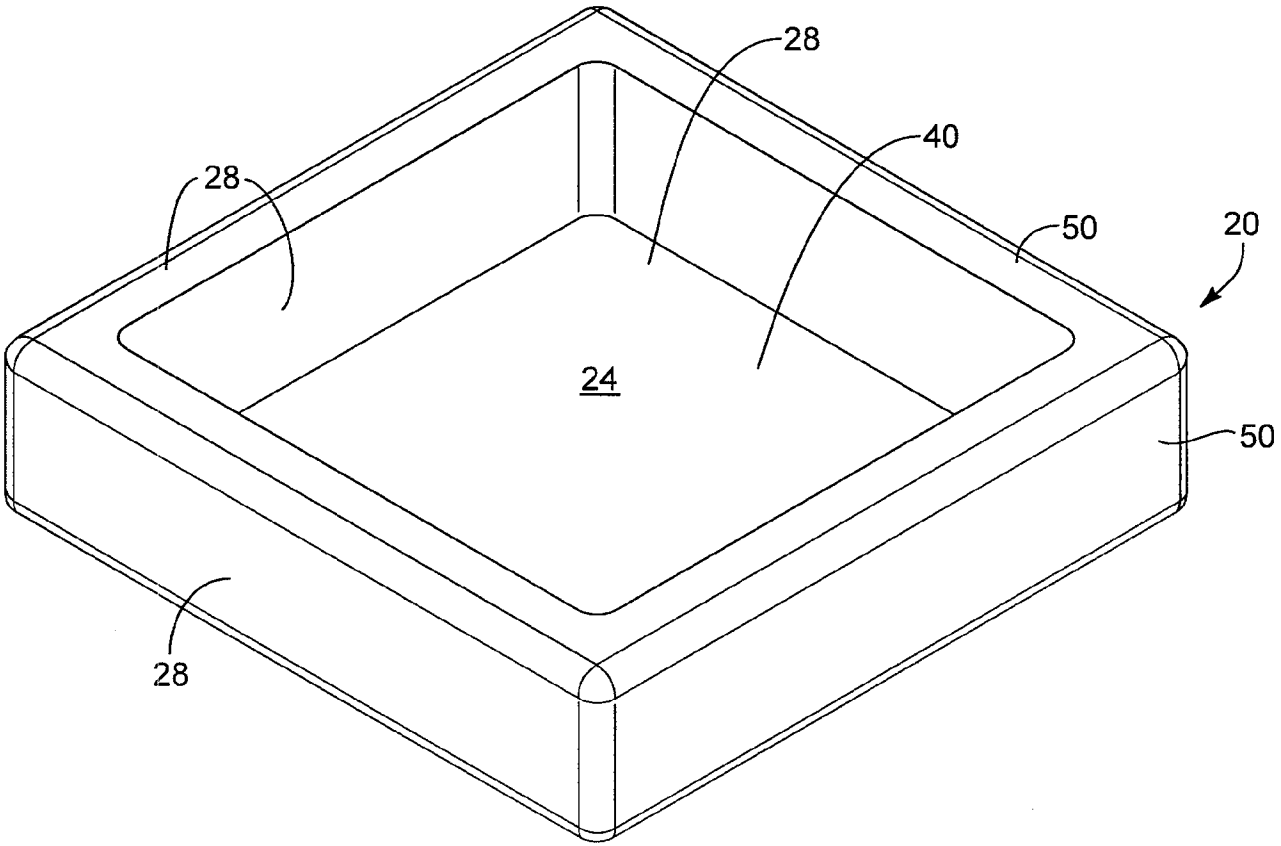
FIG. 3 is a perspective view of an enclosure in accordance with a representative embodiment of the present invention.
Figure 4:
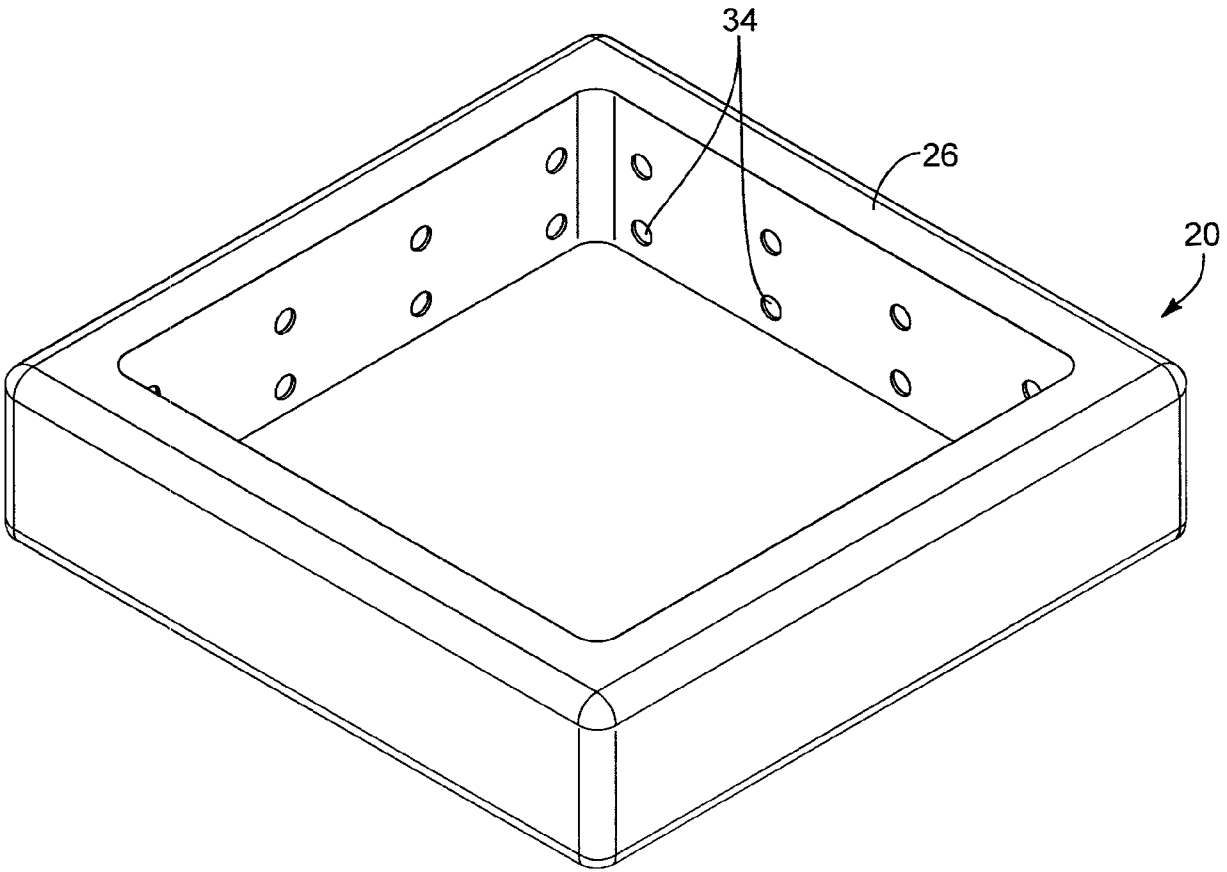
FIG. 4 is a perspective view of an enclosure encased in a non-breathable coating in accordance with a representative embodiment of the present invention.

Referring now to FIG. 3, a perspective view of enclosure 20 is shown without coating 26. Of particular note is exterior surface 28. In some embodiments, exterior surface 28 comprises an exposed, outer surface of enclosure 20. Thus, exterior surface 28 refers to the visible outer surface of enclosure 20. In some embodiments, exterior surface 28 is covered with non-breathable coating 26, as shown in FIG. 4. In other embodiments, a plurality of air exhaust ports 34 is provided in coating 26. Ports 34 provide fluid communication between enclosure 20 and interior lumen 24, such that air within the material of enclosure 20 is exchanged between the enclosure 20 and interior lumen 24 during use. Further, following removal of the user air is drawn into the interior lumen 24 via top surface 30 and subsequently passed into enclosure 20 via air exhaust ports 34.

Figure 5:
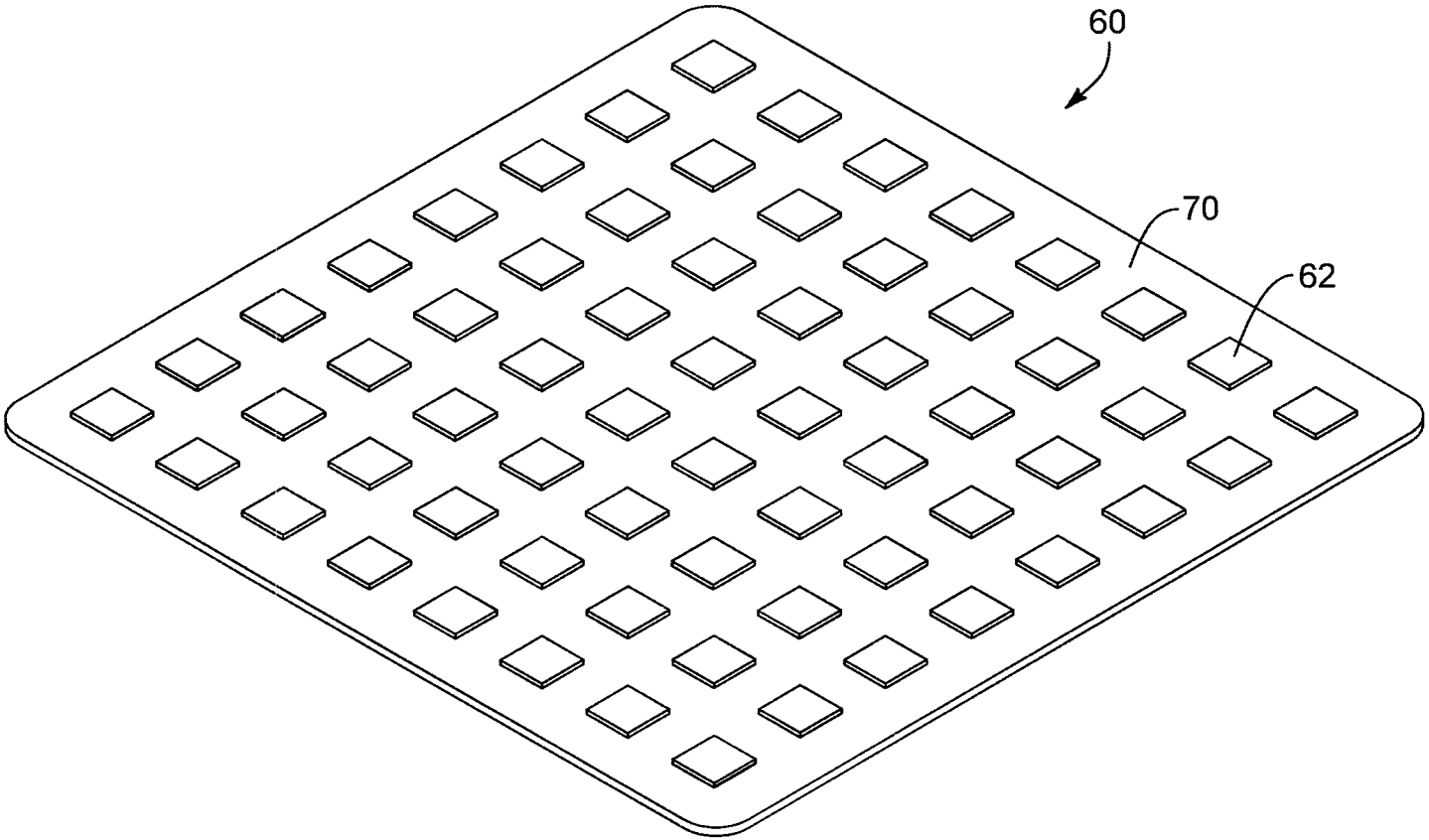
FIG. 5 is a perspective view of a gel insert in accordance with a representative embodiment of the present invention.

With reference to FIG. 5, gel insert 60 is shown. As previously discussed, some embodiments of insert 60 comprise a plurality of gel pads 62 suspended in a matrix of a breathable film material 70. Insert 60 may include any size or shape as required by a desired application. In some embodiments, insert 60 is configured to dimensionally correspond to top surface 30 of cushion 10. In other embodiments, insert 60 is configured to correspond only to those areas of top surface 30 anticipated to contact the user.

In some embodiments of the present invention, a method for manufacturing a self deflating cushion device includes: (i) providing an enclosure having a top surface, a bottom surface, and a perimeter surface; (ii) disposing a lumen within an interior of the enclosure; (iii) forming a first air chamber within a first portion of the lumen, the first air chamber being positioned adjacent to the top surface; (iv) forming a second air chamber within a second portion of the lumen; (v) interposing a first valve, such as barrier 90, between the first and second air chambers; and (vi) interposing a second valve, such as a breathable material, between the first air chamber and the top surface. In some embodiments, the method further includes providing an air exhaust port between the enclosure and at least one of the first and second air chambers. Further, in some embodiments a non-breathable covering or coating is applied to an outer surface of the enclosure. Still further, in some embodiments a gel insert is inserted between the first air chamber and the top surface.

Thus, as discussed herein, embodiments of the present invention embrace system and methods for providing a cushion. Specifically, embodiments of the present invention relates to an air cushion having a plurality of air chambers configured to permitted leakage of air in a controlled manner and to provide a cooling effect to a user.

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A cushion device adapted to provide ventilation to a user at a controlled discharge rate, the cushion device comprising:

an enclosure having a bottom surface and a perimeter surface, wherein the bottom surface and the perimeter surface define an interior lumen, wherein the enclosure comprises a barrier that limits air passage from the bottom surface and the perimeter surface and channels air through an opening at a top surface of the cushion device when the cushion device is compressed;

a first air chamber forming a first portion of the interior lumen and a second air chamber forming a second portion of the interior lumen, the first air chamber being positioned adjacent to the top surface;

a first valve interposed between the first air chamber and the second air chamber; and a second valve disposed in a position selected from at least one of being disposed at the top surface and being interposed between the first air chamber and the top surface.

2. The device of claim 1, further comprising open cell foam disposed within at least one of the first air chamber and the second air chamber.

3. The device of claim 1, further comprising a cushion insert disposed within the first air chamber.

4. The device of claim 1, wherein the first valve comprises a breathable material.

5. The device of claim 1, wherein the second valve comprises a breathable material.

6. The device of claim 1, wherein the second valve comprises an aperture that is configured to control an airflow rate of air exiting the cushion device, and to channel air to a desired location on a user, during compression of the cushion device.

7. The device of claim 3, further comprising a gel insert interposed between the cushion insert and the second valve.

8. The device of claim 7, wherein the gel insert comprises a plastisol material encapsulated within a breathable material.

9. The device of claim 1, further comprising a one-way valve between the interior lumen and an exterior environment, wherein the one-way valve is configured to allow air to enter through the valve and into the interior lumen.

10. The device of claim 1, wherein the enclosure comprises open cell foam.

11. The device of claim 2, wherein the open cell foam comprises reticulated foam.

12. A cushion device adapted to provide ventilation to a user at a controlled discharge rate, the cushion device comprising:

an enclosure having a bottom surface, a perimeter surface, and an opening, wherein the bottom surface, the perimeter surface, and the opening define a lumen;

a non-breathable barrier disposed on an outer surface of the enclosure that restricts air flow from the bottom surface and the perimeter surface and channels air through the opening of the cushion device when the cushion device is compressed;

an air chamber disposed within the lumen;

a one-way valve between the lumen and an exterior environment, wherein the one-way valve is configured to allow air to enter through the valve and into the lumen; and a first breathable material disposed over the opening.

13. The cushion device of claim 12, wherein the air chamber comprises a first air chamber forming a first portion of the lumen, and a second air chamber forming a second portion of the lumen, the cushion device further comprising a second breathable material interposed between the first and second air chambers.

14. The cushion device of claim 1, wherein the first valve and the second valve are configured to release air from the second air chamber and the first air chamber, respectively, at different rates.

15. The cushion device of claim 1, wherein the second valve comprises multiple porous layers of material, and wherein the combined porosity of the porous layers of material are configured to provide a controlled airflow rate between the interior lumen and an exterior environment.

16. The cushion device of claim 12, wherein the air chamber comprises a first air chamber forming a first portion of the lumen, and a second air chamber forming a second portion of the lumen, the cushion device further comprising a second non-breathable barrier interposed between the first air chamber and the second air chamber.

17. The cushion device of claim 12, further comprising an exhaust port in the non-breathable barrier that is configured to allow air to flow between an interior of the enclosure and the lumen.

18. The cushion device of claim 12, further comprising multiple gel pads that are disposed in a matrix of a breathable material.

19. A cushion device configured to provide ventilation to a user, the cushion device comprising:

an enclosure having a bottom surface, a perimeter surface, and an opening, wherein the bottom surface and the perimeter surface define a lumen;

a non-breathable barrier disposed on an outer surface of the enclosure that restricts air flow from the bottom surface and the perimeter surface and channels air through the opening of the cushion device when the cushion device is compressed;

an air chamber disposed within the lumen;

an exhaust port in the non-breathable barrier that is configured to allow air to flow between an interior portion of the enclosure and the interior lumen; and a first breathable material disposed over the opening.

20. The cushion device of claim 19, wherein the lumen comprises:

a first cushioning material of a first density; and a second cushioning material of a second density, wherein the first cushioning material is more dense than the second cushioning material.

* * * * *